US009572382B2

(12) United States Patent
Donovan

(10) Patent No.: US 9,572,382 B2
(45) Date of Patent: Feb. 21, 2017

(54) RAPIDLY REMOVABLE GLOVES AND RELATED METHODS

(71) Applicant: Shaun Donovan, Tucson, AZ (US)

(72) Inventor: Shaun Donovan, Tucson, AZ (US)

( * ) Notice: Subject to any disclaimer, the term of this patent is extended or adjusted under 35 U.S.C. 154(b) by 0 days.

(21) Appl. No.: 14/730,477

(22) Filed: Jun. 4, 2015

(65) Prior Publication Data

US 2015/0351471 A1 Dec. 10, 2015

Related U.S. Application Data

(60) Provisional application No. 62/008,006, filed on Jun. 5, 2014.

(51) Int. Cl.
*A41D 19/00* (2006.01)
*A41D 19/015* (2006.01)

(52) U.S. Cl.
CPC ..... *A41D 19/0041* (2013.01); *A41D 19/002* (2013.01); *A41D 19/0093* (2013.01); *A41D 19/01529* (2013.01)

(58) Field of Classification Search
CPC .... A41D 19/002; A41D 19/015; A63B 71/148
USPC ..... 2/160, 161.1, 161.5, 161.6, 163
See application file for complete search history.

(56) References Cited

U.S. PATENT DOCUMENTS 289,213 A 11/1883 Bracking
822,868 A 6/1906 Pribil, Jr. et al.
4,876,747 A 10/1989 Coffey et al.
5,203,462 A * 4/1993 Brooks ..... A63B 71/0036 211/14
5,224,220 A 7/1993 Andriola
5,294,005 A * 3/1994 Hedges ..... A47F 5/083 211/60.1
5,468,200 A 11/1995 Hoffman
5,516,150 A * 5/1996 Goode ..... A41D 19/0037 2/161.1
6,006,358 A * 12/1999 Keating ..... A63B 71/148 2/161.1
6,212,688 B1 4/2001 Leslie
6,241,134 B1 6/2001 Dunkel
8,677,514 B1 * 3/2014 Jones ..... A41D 19/0024 2/16
2010/0222189 A1 9/2010 Washington

FOREIGN PATENT DOCUMENTS

CA WO 2012151697 11/2012

* cited by examiner

*Primary Examiner* — Tejash Patel
(74) *Attorney, Agent, or Firm* — Buche & Associates, P.C.; John K. Buche; Bryce A. Johnson

(57) ABSTRACT

Disclosed is a modified set of gloves, system, and method of glove removal and retention that is particularly well suited for, but not limited to, tactical situations (i.e. fast-roping) and action sports environments. In one embodiment, the glove(s) feature at least one catch between at least two fingers of the glove(s). Preferably, the catch defines a mechanism for rapidly removing and retaining the glove(s). Further disclosed is a system for removing the glove(s) featuring a garment with an attached anchor, such as a carabineer or a hook. In a preferred embodiment, the anchor is positioned in the sternum area of the vest and glove wearer. Operably, a user moves the gloved hand(s) down and over the anchor to place the catch on the anchor so that the continued movement of the user's hands rapidly removes and stores the glove(s) via the anchor.

6 Claims, 4 Drawing Sheets

RAPIDLY REMOVABLE GLOVES AND RELATED METHODS

CROSS-REFERENCE TO RELATED APPLICATIONS

This application claims the priority and benefit of U.S. Provisional Patent Application No. 62/008,006 entitled "Rapidly Removable Gloves and Related Methods" filed Jun. 5, 2014, which is hereby incorporated by reference in its entirety as if fully set forth herein.

STATEMENT REGARDING FEDERALLY SPONSORED RESEARCH OR DEVELOPMENT

Not applicable.

BACKGROUND OF THE INVENTION

1. Field of Invention

The following application relates to gloves, methods and related systems for rapid removal and control of gloves, particularly useful in tactical situations and action sports environments.

2. Background of the Invention

Frequently, militaries send troops to combat zones. Often, troops may be transported to the combat zones via helicopter. In some cases, it may not be desirable for a helicopter to touchdown, so troops deploy from above ground as the helicopter hovers in place. One type of above ground deployment is known as "fast-roping." Fast-roping basically requires the soldiers to repel down a rope like firefighters sliding down a fire-pole. This fast-roping technique creates a tremendous amount of heat from friction, particularly as the rope moves through the soldiers' hands. Consequently, fast-roping soldiers wear thick or padded gloves to prevent friction burn.

Thick and padded gloves are problematic for fast-roping into combat zones because fast-roping soldiers are vulnerable to attack immediately after they exit the helicopter and soldiers often cannot effectively access their weapons until after both reaching the bottom of the rope and removing the thick and padded gloves. Quick removal of fast-roping gloves is therefore of paramount importance, since access to more finessed hand and finger dexterity can mean life or death in combat zones. Understandably, soldiers in combat zones cannot spare the time or mental effort, to place removed gloves in a pocket or storage area and, as a result, many fast roping gloves are lost and must be replaced. In view of the foregoing, a need exists for apparatus and related methods of quick and calculated removal plus retention of fast-roping gloves. Although a primary use may be among soldiers, there are a variety of professions or situations that may also benefit from the ability to rapidly remove and store gloves, including but not limited to firefighters and police, iron and construction workers, and action sports athletes, to name a few. Essentially, any situation that requires taking gloves on and off and storage of theses gloves is contemplated.

There have been several inventions for hastening the removal of gloves, although none of them have worked and solved the problem as effectively as the embodiments of the present application. For instance, U.S. Pat. No. 5,224,220 to Andriola teaches a glove with a pull-tab having five nylon string attached to each finger-tip of the glove. During ordinary glove operation, the tab is secured to the back of glove with the strings pulled taut. When the user is ready to remove the glove, the user unfastens and pulls the tab, which tugs the glove off the hand from each fingertip at the same time. However, this particular glove is designed with tight fitting sports gloves, such as baseball batting gloves, and would be impractical for the heavy gloves worn during fast-roping. The dainty tab would be hard for the thickly-gloved hand to grip and the nylon strings can easily break. Furthermore, Andriola's glove requires several steps to remove, which is not ideal when speed is a primary concern.

Like Andriola's invention, there are other mechanisms that assist users with removing gloves. WO 2012/151697 to Garneau teaches a glove with tabs on each finger to remove the glove. U.S. Pat. No. 5,468,200 to Hoffman teaches a glove with loops located near the joint between the proximal and intermediate phalanges. Both Garneau's invention and Hoffman's invention are specifically designed to work with tight fitting gloves, and are ill-suited for thick fitting gloves of the variety discussed in this application. Also, these gloves require pulling on each finger one-at-a-time, which is too thought intensive and time consuming for tactical situations.

In addition, there have been several inventions for removing tight-fitting stretchable or latex gloves that may be contaminated with various pathogens. U.S. Pat. No. 4,876,747 to Coffey discloses a glove removal system where the wrist of the glove features a loop. The loop fits around a hook and once the user has secured the loop around the hook, the user pulls his/her arm away from the hook so that the glove is removed. Similar to Coffey's system is the glove removal system of Dunkel (U.S. Pat. No. 6,241,134). Dunkel teaches a thin flat lever which is attached to a waste bin. A user inserts the lever between the glove and the hand and then moves his/her hand away from the lever and the lever peels the glove off, and the glove falls into the wastebasket. Both Dunkel and Coffey's systems are impractical for heavy duty gloves that cannot be peeled off. Furthermore, the primary purpose in both Dunkel and Coffey's system is to remove the glove without cross contamination, and as a result, the speed of the glove removal is sacrificed.

While there are systems for assisting with glove removal, none of these known glove removal systems mentioned above allow for quick removal and rapid retention of the gloves—and they do not address ideal angles of ergonomic removal with minimal expenditure of energy. U.S. Pat. No. 6,212,688 to Leslie teaches a device for firefighters' gloves. Leslie discloses a small strap of fireproof material that is clipped on to the exterior of a firefighter's uniform. This ensures that a firefighter always has his/her glove readily available in case of an emergency. While this is a retention method, the technology does not adequately address the needs of a fast and efficient removal of a glove. The system would require too much dexterity to remove and clip—whereas the present application deals with rapid removal and storage of gloves at a time when dexterity is at a minimum. The Leslie system involves multiple steps for securing the gloves to the outfit of a firefighter. Leslie's system simply is not adequately adapted for a fast-roping combat soldier, and even other situations because it is overly complex and not ideally efficient.

In summary, glove removal for a fast-roping combat soldier is dangerous. For other tactical situations, better systems are needed. Systems are known for removing sports gloves, but those removal systems are neither (a) suited for high-stress situations or heavy-duty gloves nor (b) enable quick retention of the gloves with nominal planning. Thus, there is a need for apparatus and related methods of quick and rapid removal, followed by subsequent storage of heavy duty gloves.

SUMMARY OF THE INVENTION

Accordingly, it is an object of the present application to present a system, gloves, and related methods for rapidly removing and nearly simultaneously storing thick, loose-fitting, or heavy duty gloves, including, but not limited to, those of the sort used in fast-roping missions or other high stress situations, such as in construction sites or action sports environments, where time is of the essence and simplicity is necessary.

It is a further object of the present application to present glove(s) that can easily be removed from the wearer using minimal expenditure of body energy and with minimal needs for finessed movements.

It is a further object of the present invention to easily store gloves that have been rapidly removed without wasting extra time.

Disclosed are glove(s) for fast-roping, and other tactical situations, which are configured for quick removal accompanied by nearly simultaneous retention/storage. The system and gloves of this invention may also be used by snowboarders and skiers, who also need to frequently remove and rapidly store gloves. In one embodiment, the gloves each feature at least one loop between either (a) the tips of the index and middle finger or (b) the ring finger and middle finger of the gloves, with the latter arrangement being most preferable because of how the user's wrists bend. The loop may also be situated in other embodiments between any of the fingers. Preferably, the loop defines a mechanism for rapidly removing and retaining the glove. Further disclosed is a system for removing the glove featuring a tactical vest with an attached anchor. In a preferred embodiment, the anchor is positioned in the sternum area of the vest and glove wearer. Operably, a user moves the gloved hands in a swift downward motion (with palms facing away from each other) over the anchor to catch the loop so that the continued movement of the user's hands rapidly removes and retains the glove via the anchor. The user's hands are rapidly freed of the heavy gloves, which are then stored securely on the user's vest as they are removed.

Other objectives of the invention will become apparent to those skilled in the art once the invention has been shown and described.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

Generally disclosed is a glove for fast-roping, or other tactical and sport situations, that is configured for rapid and simple removal and subsequent retention. In one embodiment, the gloves each feature at least one loop between either (a) the tips of the index and middle finger or (b) the ring finger and middle finger of the gloves, with the latter configuration being most preferable due to requiring less inwardly twisting wrist movement. Other arrangements are contemplated with the loop occurring between any of the fingers. Preferably, the loop (which is more of a half-loop) defines a mechanism for rapidly removing and retaining the glove. Further disclosed is a system for removing the glove featuring a tactical vest with an attached anchor. In a preferred embodiment, the anchor is positioned in the sternum area of the vest and glove wearer. Operably, a user moves the gloved hands down and over the anchor, with palms facing outward, to catch the loop so that the continued movement of the user's hands rapidly removes and retains the glove via the anchor. In operation, the user's hands may make a downward "W" motion and the hands are pulled out of the gloves, which remain hooked on the anchor. The user's hand are then free to do whatever requires the finer motion, whether that be grabbing a rifle, a blowtorch, or a ski lift. This directional removal of the gloves, and the downward motion takes consideration of ergonomics, and the relative ease of a gross downward motion where the wrists turn inward minimally, and where minimal dexterity is required to hook the gloves. Unlike the prior art, minimal thought and effort are required to both remove and secure the gloves. In an alternative embodiment, the user may adapt the system so the user's hands are palm down facing his torso, and the removal motion is by pulling respective arms outwards and/or backwards while leaving the glove(s) on a centrally disposed hook. This motion would not require inverting the wrists. Additionally, for this embodiment, the loops may be more preferably situated between the index and middle fingers, although it would still be possible to have the looping/hooking mechanism between other fingers.

Figure 1:
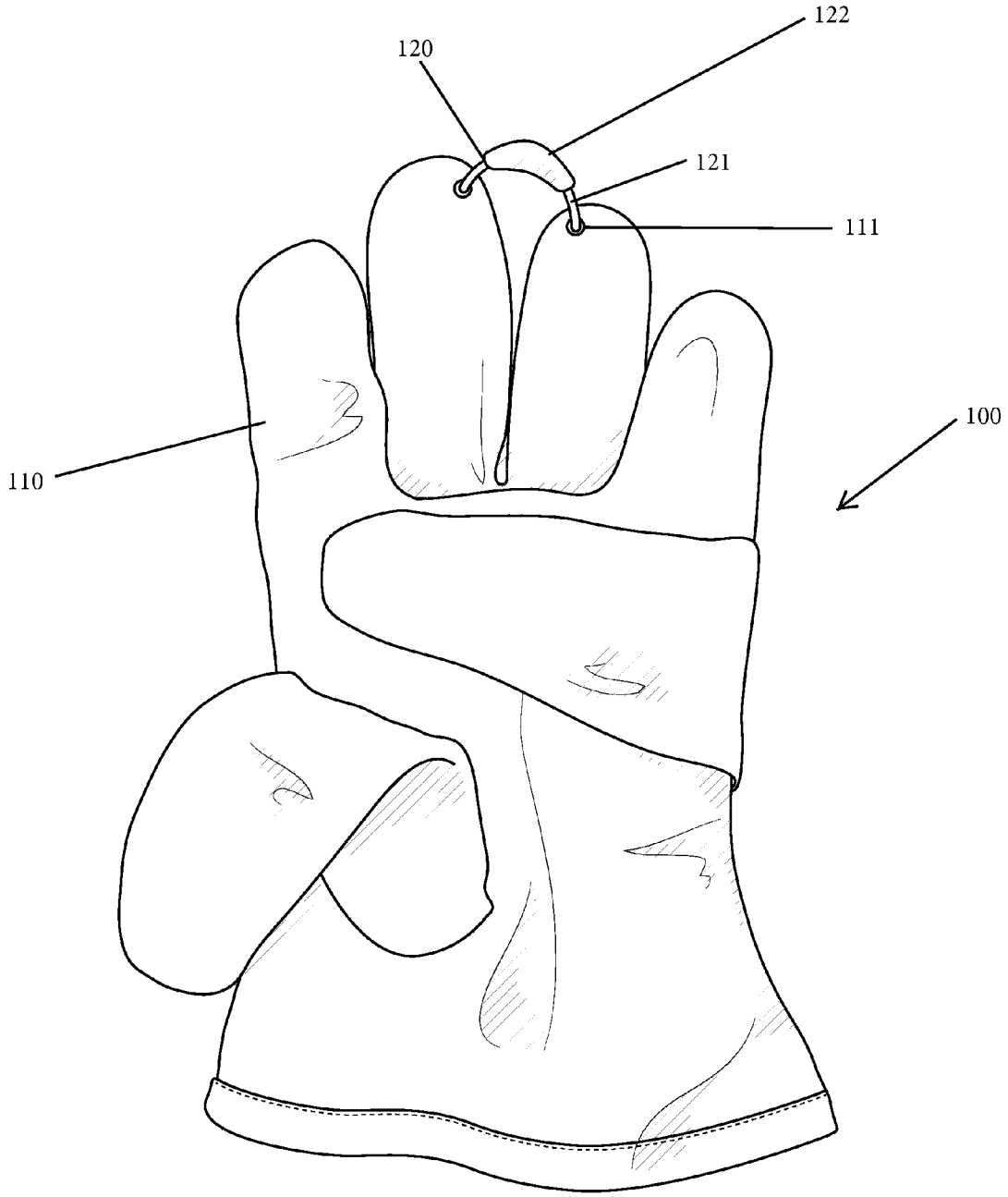
FIG. 1 is a front view of a glove.

FIG. 1 is a front view of a glove 100. The glove features a body 110 and a loop 120. The loop 120 is preferably located between the middle and ring fingers of the body 110 of the glove 100, and actually typically defines a half-loop, or catch, that is anchored fixedly and extends therebetween two fingers of the glove(s). The body 110 of the glove 100 is preferably made from a heavy duty fabric, such as leather or other polymer fabrics. It may be reinforced with latex or rubber. In some embodiments, the body 110 of the glove 100 is padded.

Still referring to FIG. 1, between the tips of the middle and ring fingers (in a most ideal embodiment) of the body 110 of the glove 100, is a loop 120. The arrangement of the loop 120 (also referred to as a catch) being situated between the middle and ring fingers is ideal because it requires less inward rotation of the wrists of a user to position the gloves so they may be hooked by the anchor following a downward motion. In an alternate embodiment the loop 120 is located between the index and middle finger. In the preferred embodiment, the loop 120 line 121 is reinforced with a hard exterior 122. In the embodiment shown, the line 121 is threaded through two grommets 111 located at the tips of the middle and ring fingers. The grommets, or other anchored securing mechanisms are used so that forceful motion of the user will securely pull the gloves from the user's hands. The line 121 is ideally covered with a hard exterior 122 which serves two purposes: it keeps the line 121 securely in place between the middle and ring fingers and it assists with the removal of the glove 100. The hard exterior 122 of the loop 120 is preferably constructed from metal, but may also be constructed from a strong, durable plastic material, such as high density polyethylene or polypropylene.

Figure 2:
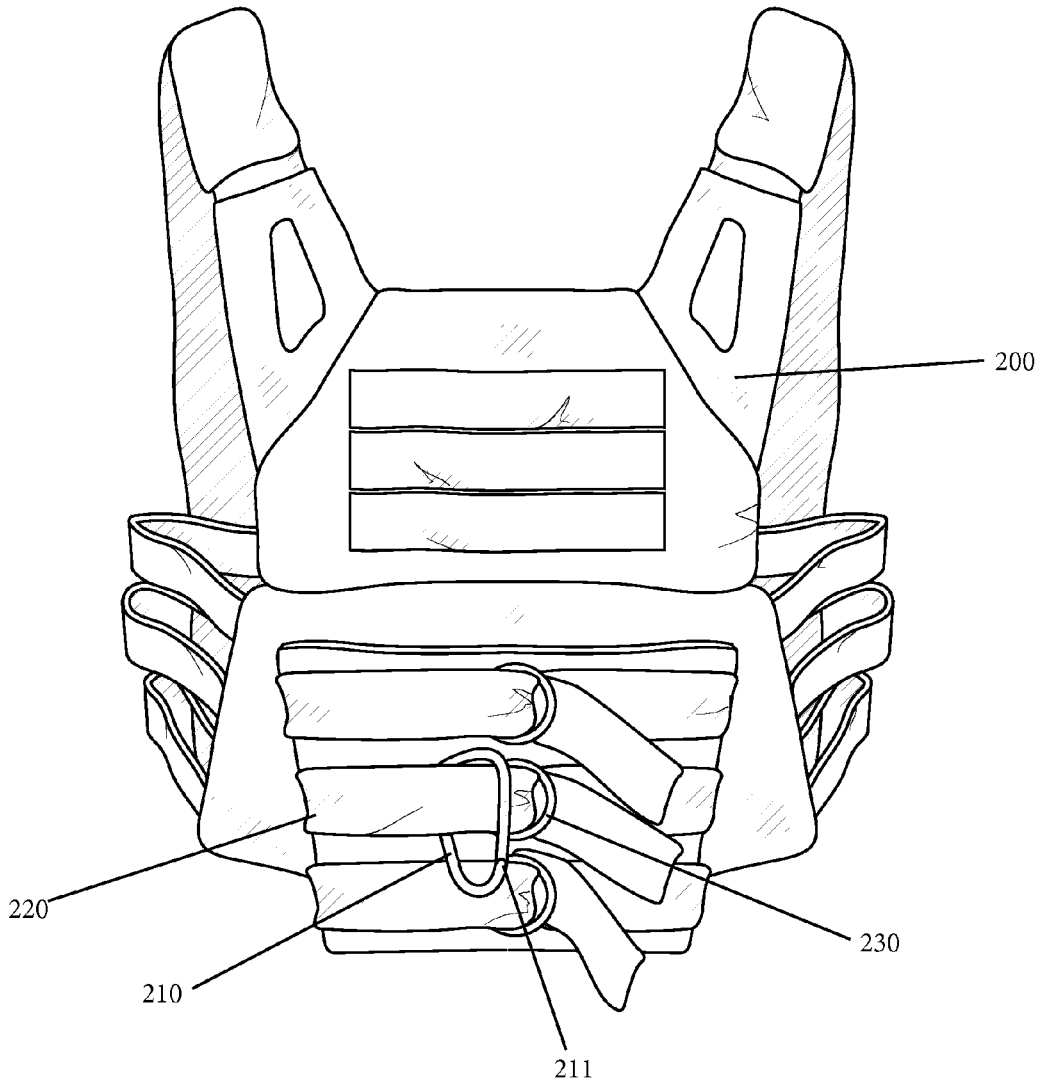
FIG. 2 is a front view of a vest that is part of a removal system for the glove of FIG. 1; and, FIG. 3 is an environmental view of a glove and vest system.

FIG. 2 depicts a vest 200. The vest 200 assists the user with rapidly removing the glove 100 and can be a part of the overall system of glove removal. The vest 200 is a standard tactical vest with additional features for rapidly removing the glove 100 of FIG. 1. It would not be uncommon for a vest 200 to be of the MOLLE variety known to persons in tactical environments. In the preferred embodiment, the vest 200 features a selectively openable anchor 210, which may be a carabineer or a hook. The anchor 210 is attached to the front of a garment, such as a vest 200, and is preferably located central to the user's chest or solar plexus so that each arm is positioned relatively equally to user's center and removal of the gloves will be a fluid downward centralized motion in the "W" pattern previously discussed. The anchor 210 features an opening mechanism, typically a latch 211 that faces outward from the wearer. In this embodiment, the anchor 210, which may be a carabineer or hook, is attached to the vest using a strap 220 and a buckle 230, but it may be attached to the vest 200 by any other mechanism, such as a D-ring, or it may be sewn onto the vest 200. The anchor 210 is preferably constructed from metal, but may be made from a strong durable plastic material as well. In an alternate embodiment (not shown), the vest 200 features a hook as the anchor to assist the user with removing the glove. In another embodiment (not shown) the anchor is attached to a different article of clothing such as a coat, a jacket, or a belt. Additionally, the anchor 210 may be attached to any portion of a garment. In an alternative embodiment, the anchor 210 may also be attached to a user's equipment, such as a backpack strap. Moreover, the anchor 210 may be oriented vertically or horizontally.

Figure 3:
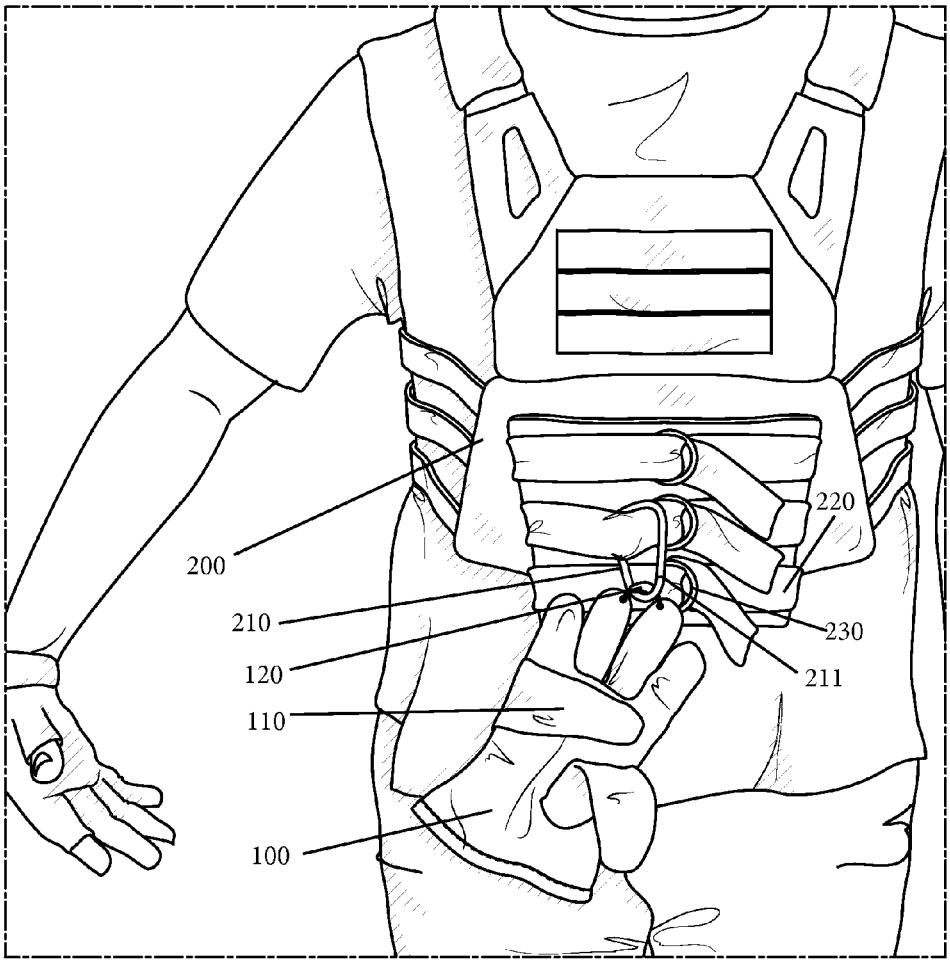
Figure 4:
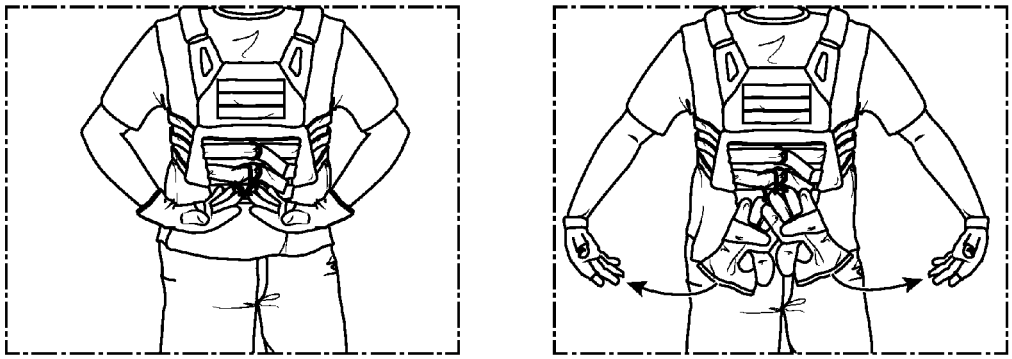
FIG. 4 is flow diagram of one method of glove removal.
Figure 5:
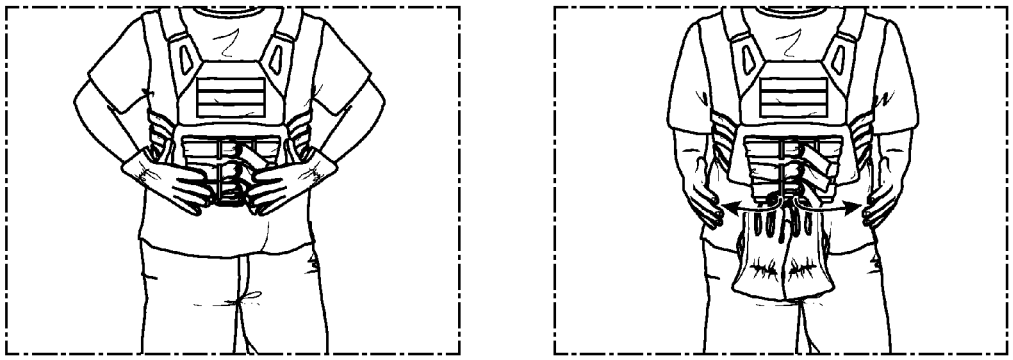
FIG. 5 is a flow diagram of another method of glove removal.
Figure 6:
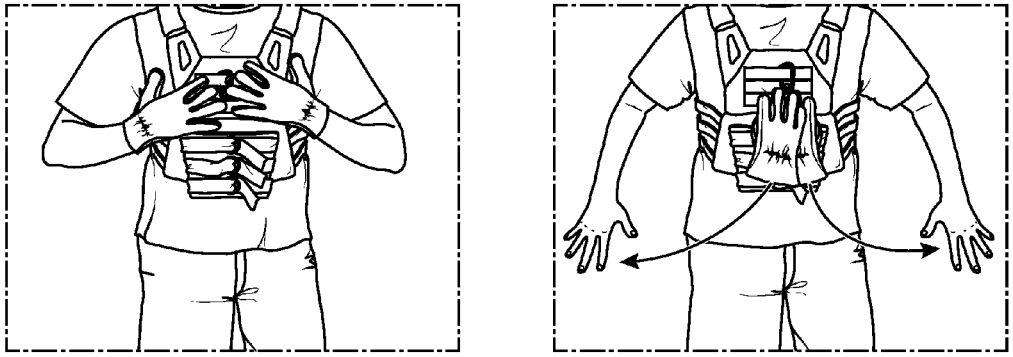
FIG. 6 is a flow diagram of an alternative method of glove removal.

FIG. 3 depicts an environmental view of the glove 100 removal system and shows how a user can use the glove 100 and vest 200 to rapidly remove the glove. To remove the glove 100, a user will slide his hand(s) down and in front of the vest 200, or sideways along the vest 200, with enough force so that the latch 211 of the anchor 210 opens as the glove 100 passes over the anchor 210. The motion is ideally made with both hands, although it could be one hand at a time too. Referring to FIG. 4, in one method of glove removal, the user will turn his or her wrist so that the palms are facing substantially upwards so that the loop 120 is situated toward the anchor 210. The downward and outward motion of the user's arm removes the hand from the glove 100, which is left caught on the anchor 210. The loop 120 of the glove 100 will hook onto the anchor 210. The latch 211 of the anchor 210 will close once loop 120 has hooked on the anchor 210 and the user can quickly remove his/her outer glove 100. The glove 100 will remain hooked onto the anchor 210, so a user does not have to worry about discarding the glove 100, or worse, trying to pick it up and store it somewhere. The entire process of removing the glove 100 takes only seconds and eliminates a period of fiddling with gear (unhooking and storing) that could be more effectively used to accomplish a tactical task at hand, such as rapidly securing and deploying a rifle. The user also knows exactly where the gloves are stored for future use. The downward and arcing motion of the user's hand from the glove is notable in FIG. 4, including the preferable orientation of the wrist. In an alternative embodiment, referring to FIG. 5, an anchor 210 may be oriented horizontally and the user may remove a glove 100 by orienting his/her palms towards their torso and slide his/her hand(s) in a sideways motion, and in opposite directions if done with two hands, towards the sides of his or her body along the anchor 210 with enough force so that the latch 211 of the anchor 210 opens as the glove 100 passes over the anchor 210. The motion is ideally made with both hands, although it could be one hand at a time too. The sideways motion of the user's hand(s) removes the hand from the glove 100, which is left caught on the anchor 210. The loop 120 of the glove 100 will hook onto the anchor 210. The latch 211 of the anchor 210 will close once loop 120 has hooked on the anchor 210 and the user can quickly remove his/her outer glove 100. The glove 100 will remain hooked onto the anchor 210, so a user does not have to worry about discarding the glove 100, or worse, trying to pick it up and store it somewhere. Referring to FIG. 6, in an alternative method of glove removal, the anchor 210 may be secured at a central location on the front of a user's torso and the user will have his or her palms facing towards his torso so that the loop 120 is situated toward the anchor 210. The downward and outward motion of the user's arm removes the hand from the glove 100, which is left caught on the anchor 210. The loop 120 of the glove 100 will hook onto the anchor 210. The latch 211 of the anchor 210 will close once loop 120 has hooked on the anchor 210 and the user can quickly remove his/her outer glove 100. The glove 100 will remain hooked onto the anchor 210.

Minimally disclosed is a system of removing gloves comprising: at least one glove featuring a plurality of fingers, with a catch extending therebetween at least two of the fingers of said glove; a selectively openable anchor locatable on a garment on a user's person, wherein a swift downward motion of said user's hands allows said catch of said glove to engage said anchor so that said gloves are removed from user's hands and removably fixed to said anchor. The selectively openable anchor is typically a carabineer centrally fixed to a vest, garment, or user's equipment, such as a belt or backpack strap. Also disclosed is a method of removing gloves comprising the steps of: obtaining and wearing at least one glove with a body and featuring a plurality of fingers, with a catch extending therebetween at least two fingers of said glove; wearing a selectively openable anchor on a garment or equipment on a user's person; making a decision to remove at least one of said gloves from a user's hand; motioning in a manner that places the catch of the glove on the openable anchor while wearing said glove; and, continuing a motion in a manner to cause said glove to be removed from a user's hand. The method may also include an initial step of fast roping out of a helicopter wearing said glove(s). The method may also include a motion that is defined by a substantially sideways motion, wherein the user's palms are facing the torso and fingers pointed towards each other, wherein the user swipes his hands in a sideways manner away from the center of the user's torso. The method may also include a motion that is defined by a substantially downward motion, wherein the pathways define a "W" pattern, wherein the apex of the center portion of the "W" would be the anchor point on a user's torso. The method may also include a motion that is defined by a substantially downward motion, wherein a user's palms are facing substantially upwards, where the motion pathways define a "W" pattern, wherein the apex of the center portion of the "W" would be the anchor point on a user's torso. The method may also include a motion that is defined with each user's palms facing towards the user's torso, and where the motion is a downward swiping motion moving from a central location with each hand moving in opposite directions to the sides of the user. Disclosed is a glove comprising: a body featuring a plurality of fingers; a reinforced catch extending therebetween at least two fingers of said glove wherein said glove and said catch is operably configured to catch on an anchor of a garment or equipment of the user, and thereafter removed from the hand of the user and stored. The glove may be configured so that the catch is situated between the middle and ring finger or the middle and index finger. The catch may feature a hard exterior. The catch may be reinforced with grommets. The glove is typically made of a heavy fabric.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All features disclosed in this specification, including any accompanying claims, abstract, and drawing, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step of" in the clause as specified in 35 U.S.C. §112, paragraph 6 may not be intended as a means plus claim.

The claims filed herewith are incorporated by reference into this specification as if fully set forth herein.

I claim:

1. A method of removing at least one glove comprising the steps of:

obtaining and wearing said at least one glove on a hand of a user, said at least one glove with a body and featuring a plurality of fingers, with a catch extending therebetween at least two fingers of said glove;

wearing at least one selectively openable anchor on a garment or equipment on the user's person;

making a decision to remove said at least one glove from the user's hand;

motioning the user's hand in a manner that places the catch of the glove on the openable anchor while wearing said at least one glove on said user's hand; and, continuing a motion in a manner to cause said at least one glove to be removed from said user's hand.

2. The method of claim 1 with an initial step of fast roping out of a helicopter by the user while wearing said at least one glove.

3. The method of claim 1 wherein the motion is defined by substantially sideways motion, wherein the user's palms are facing the torso and fingers pointed towards each other, wherein the user swipes his hands in a sideways manner away from the center of the user's torso.

4. The method of claim 1 wherein the motion is defined by a substantially downward motion, wherein the pathways define a "W" pattern, wherein the apex of the center portion of the "W" would be the anchor point on a user's torso.

5. The method of claim 1 wherein the motion is defined by a substantially downward motion, wherein a user's palms are facing substantially upwards, where the motion pathways define a "W" pattern, wherein the apex of the center portion of the "W" would be the anchor point on a user's torso.

6. The method of claim 1 wherein the motion is defined with each user's palms facing towards the user's torso, and where the motion is a downward swiping motion moving from a central location with each hand moving in opposite directions to the sides of the user.

* * * * *